US011011287B2

(12) United States Patent
Sunnegårdh et al.

(10) Patent No.: US 11,011,287 B2
(45) Date of Patent: May 18, 2021

(54) ELECTRICAL HV TRANSMISSION POWER CABLE

(71) Applicant: BOREALIS AG, Vienna (AT)

(72) Inventors: Peter Sunnegårdh, Kallinge (SE); Marc Jeroense, Karlskrona (SE); Anders Gustafsson, Karlskrona (SE); Pär Lilja, Ronneby (SE); Per-Ola Hagstrand, Stenungsund (SE); Villgot Englund, Gothenburg (SE); Annika Smedberg, Myggenäs (SE); Ulf Nilsson, Ödsmål (SE); Johan Andersson, Hisings backa (SE); Virginie Eriksson, Stenungsund (SE); Jonas Jungqvist, Stenungsund (SE); Jonny Brun, Nödinge (SE)

(73) Assignee: Borealis AG, Vienna (AT)

( * ) Notice: Subject to any disclaimer, the term of this patent is extended or adjusted under 35 U.S.C. 154(b) by 661 days.

(21) Appl. No.: 15/106,011

(22) PCT Filed: Aug. 19, 2014

(86) PCT No.: PCT/EP2014/067668
§ 371 (c)(1),
(2) Date: Jun. 17, 2016

(87) PCT Pub. No.: WO2015/090643
PCT Pub. Date: Jun. 25, 2015

(65) Prior Publication Data

US 2016/0322129 A1 Nov. 3, 2016

(30) Foreign Application Priority Data

Dec. 19, 2013 (WO) ..... PCT/EP2013/077404

(51) Int. Cl.
*H01B 9/02* (2006.01)
*H01B 3/44* (2006.01)
*H01B 13/24* (2006.01)

(52) U.S. Cl.
CPC ..... *H01B 9/027* (2013.01); *H01B 3/441* (2013.01); *H01B 13/24* (2013.01)

(58) Field of Classification Search
CPC ..... H01B 13/24; H01B 9/027; H01B 3/441; C08K 5/14; C08K 5/375; C08L 23/10; C08L 23/04; C08L 23/0815; C08L 23/08
See application file for complete search history.

(56) References Cited

U.S. PATENT DOCUMENTS 6,180,706 B1 * 1/2001 Keogh ..... C08K 5/0025 174/110 PM
6,187,858 B1 * 2/2001 Tachikawa ..... C08K 5/1345 428/377

(Continued)

FOREIGN PATENT DOCUMENTS

CN 102597021 A 7/2012
WO 2011057927 A1 5/2011
WO 2012150285 A1 11/2012

OTHER PUBLICATIONS

Chinese Office Action and Translation Application No. 2014800741740 dated Feb. 17, 2017 11 pages.

(Continued)

*Primary Examiner* — Timothy J Thompson
*Assistant Examiner* — Paresh H Paghadal
(74) *Attorney, Agent, or Firm* — Whitmyer IP Group LLC

(57) ABSTRACT

A transmission cable includes a conductor or a bundle of conductors extending along a longitudinal axis, which is circumferentially covered by an insulation layer having an extruded insulation material, whereby the transmission cable passes the electrical type test as specified in Cigré TB496, (Continued)

whereby the rated voltage $U_0$ is 450 kV or more. The type test includes subjecting the power cable to a DC voltage of $1.85*U_0$ during 10 to 15 cycles at negative polarity, followed by a polarity reversal with another 10 to 15 cycles at positive polarity at a DC voltage of $1.85*U_0$, followed by additional 2 to 5 cycles during at least 4 to 10 days at positive polarity, and wherein $U_0$ is 450 kV, or 525 kV, or more.

8 Claims, 3 Drawing Sheets

(56) References Cited

U.S. PATENT DOCUMENTS

| | | | | |
|---|---|---|---|---|
| 6,191,230 | B1 * | 2/2001 | Keogh | C08K 5/0025 428/374 |
| 2010/0036031 | A1 * | 2/2010 | Herbst | C08K 5/00 524/331 |
| 2012/0017404 | A1 | 1/2012 | Poulakis | |
| 2012/0305284 | A1 * | 12/2012 | Nilsson | C08F 10/02 174/110 SR |
| 2014/0083739 | A1 * | 3/2014 | Jeker | H01B 1/24 174/120 SC |
| 2016/0314869 | A1 * | 10/2016 | Hagstrand | C08K 5/375 |
| 2016/0319104 | A1 * | 11/2016 | Hagstrand | H01B 3/441 |
| 2016/0322124 | A1 * | 11/2016 | Englund | C08K 5/36 |
| 2016/0329124 | A1 * | 11/2016 | Hagstrand | C08K 5/14 |

OTHER PUBLICATIONS

International Preliminary Report on Patentability Application No. PCT/EP2014/067668 dated Apr. 8, 2016 10 pages.

International Search Report and Written Opinion of the International Search Authority Application No. PCT/EP2014/067668 Completed: Aug. 29, 2014; dated Sep. 5, 2014 15 pages.

Written Opinion of the International Preliminary Examining Authority Application No. PCT/EP2014/067668 dated Nov. 24, 2015 9 pages.

Chinese Office Action Application No. 201480074174.0 Completed: Oct. 8, 2018 6 Pages.

Translation of Chinese Office Action Application No. 2014800741740 Completed: Oct. 8, 2018 7 Pages.

Chinese Office Action w/ translation Application No. 2014800741740 dated Dec. 21, 2017 14 pages.

European Office Action Application No. 14752868.1 dated Jul. 11, 2018 7 pages.

* cited by examiner

ELECTRICAL HV TRANSMISSION POWER CABLE

TECHNICAL FIELD

The present invention refers to an improved HV transmission power cable that passes the requirement of the type test as specified in Cigré TB496. The invention especially relates to a transmission cable comprising a conductor or a bundle of conductors extending along a longitudinal axis, which is circumferentially covered by an insulation layer comprising an extruded insulation material, whereby the extruded insulation material passes the electrical type test as specified in Cigré TB496, whereby the rated voltage $U_0$ is 450 kV or more.

BACKGROUND

Electrical power transmission systems, such as cables, that are used for the transmission of power generally comprise a metallic conductor surrounded by an insulating coating. Insulation for such transmission cables is important for the reliability of the transmission cable. The reliability depends on the material used for covering the conductor or conductor layers. Extruded insulation materials for direct current (DC), alternating current (AC) or transient current (impulse) power cables may be exposed to high stresses. This is especially true for extruded insulation materials used in high voltage and extra/ultra high voltage (hereinafter collectively referred to as HV) systems. Such extruded insulation materials require a good combination of electrical, thermal and mechanical properties to provide for a system having an optimal power transmission capacity. The extruded insulation material is suitably flexible, strong and nonconductive.

A typical transmission cable comprises a conductor or a bundle of conductors extending along a longitudinal axis, which is circumferentially covered by an insulation layer comprising the extruded insulation material. The insulation layer may be covered by a sheath.

As illustrated in FIGS. 2 and 3, for some transmission cables, such as HVDC cables, the conductor 7 may be circumferentially covered by an inner or first semiconductive layer 8, which layer is then covered by the extruded insulation layer 9. The extruded insulation layer 9 may be circumferentially covered by an outer or second semiconductive layer 10. The second semiconductive layer 10 may be covered by a screen and/or sheath 11, which may be lead or another metal. This sheath may be further covered by a protection layer 12 that may also have insulation and mechanical properties such as a plastic or rubber material. The transmission cables may also be a concentric cable with a metallic return.

At voltages over hundreds of kV, the extruded insulation material must be strong enough to withstand the voltage, since the conductor of the cable is on high voltage potential and the periphery of the cable has to be on earth potential. Losses of energy are reduced by increasing the voltage.

As shown in FIG. 1, for illustrative purposes only, a plant for transmitting electrical power has a direct voltage network 1 for HVDC having two cables 2, 3 for interconnecting two stations 4, 5, which are configured to transmit electrical power between the direct network 1 and an alternating voltage network 6, 7, which may have three phases and connected to the respective station. One of the cables 2 is intended to be on positive potential, while the other cable 3 is on negative potential. Accordingly, the plant has a bipolar direct voltage network. A monopolar network with a return current flowing through earth electrodes is also conceivable.

There is a need for transmitting more power in HV transmission cables. This can be done by increasing the size of the transmissions cables, or by increasing the current by using conductors with a higher conductivity. This conductivity is however limited by the conductor material, such as copper or aluminium. Another way of increasing the capacity of transmission cables is by improving the extruded insulation material.

The types of HVDC cables commonly used today are mass impregnated cables, oil-filled cables, and extruded cables. The electrical field acceptable for these cables is for the mass impregnated cables around 30 kV per millimetre and for extruded cables around 20 kV per millimetre.

The preference of extruded cables also for applications in HVDC has been obvious, because of the relative light weight and flexibility. Several reports have been published in the past, where crosslinked low density polyethylene (XLPE) has been tested for HVDC applications. The cables are operated in bipolar mode, one cable with positive polarity and one cable with negative polarity. The cables are installed close in bipolar pairs with anti-parallel currents and thus eliminating the magnetic fields.

Extrusion is a technique to deposit a uniform layer of an olefin polymer around a conductor, between two layers of semiconductive layers. The extruded insulation layer is obtained through a single extrusion process of the entire insulation thickness plus the inner and outer semiconductive layers, followed by a crosslinking phase of the insulation to the appropriate thermomechanical properties. In a so-called triple extrusion line, the bare conductor enters the triple extrusion head, where insulation and semiconductive layers are applied in sequence. Then, the insulated conductor enters a vulcanization pipe at high pressure and high temperature for the thermochemical crosslinking treatment. Degassing may be applied to remove the by-products from the crosslinking process.

An extruded resin composition typically comprises an olefin polymer as the base component. Olefin polymers, such as polyethylene polymers, e.g. low density polyethylene, have been used as extruded insulation materials for low, medium and high voltage cables. Olefin polymers may be cross-linked by using a cross-linking agent. These polymers have advantageous processability and electrical properties.

However, this material may not always be suitable for use in transmission cables for HV, such as voltages over 320 kV. One reason may be the existence of space charges in the insulation leading to uncontrolled local high electric fields causing dielectric breakdowns. Another reason may be uneven stress distribution due to temperature dependent resistivity causing overstress in the outer part of the insulation layer.

The space charges distort the stress distribution and persist for a long period, because of the high resistivity of the polymers. When subjected to the forces of an electric DC-field, space charges accumulate in an insulation body. As a result, a polarized pattern similar to a capacitor is formed. This results in a local increase of 5 or even 10 times in electrical field in relation to the contemplated field for the cable.

Space charges build up slowly in the insulation layer. This process is accentuated when the polarity of the cable is reversed. As a result of the space charge accumulation, a capacity field is superimposed on the field when the polarity is reversed, especially when the reversal is done after a long period of using one polarity. As a consequence, the point of maximum field stress is moved from the interface and into the insulation layer.

To improve the physical properties of the extruded insulation and its capacity to withstand degradation and decomposition under the influence of conditions prevailing under production, shipment, laying and use, the olefin polymer based insulation material may comprise additives such as stabilizers, ion scavengers, anti-oxidants, lubricants, scorch retarding agents, fillers, and the like. When selecting additive, the aim is to improve certain properties, while other properties are maintained or also improved. However, in practice it has shown to be difficult to choose and forecast the effect of additives. For example, certain additives do not bind with the olefin polymer and start migrating.

When selecting materials for HVDC insulation intended for high electric fields, the conductivity has to be sufficiently low in order to avoid significant temperature rise due to the leakage current. What is sufficiently low depends on the heat transfer conditions of the cable as well as on the intended electrical field. Since the heat generation is proportional to the square of the electrical field it is easy to understand that the conductivity has to be lower, the higher the electrical field, in order to keep the temperature rise fixed. The better the cooling of the cable, the higher heat generation can be allowed for fixed temperature rise. The cooling conditions can be characterized by the heat transfer coefficient of the cable surface and the cable diameter. In addition, the thickness of the insulation layer in which the heat is generated influences the temperature rise for two reasons. One is that the thicker the insulation at fixed electrical field the more power is dissipated that has to be cooled by the cable surface. The other is that the electrical insulation also will act as thermal insulation and therefore a thicker insulation layer will cause a larger temperature difference between the inner and outer part of the insulation layer. For the development of extruded high performance insulation materials for HVDC that would allow higher voltage of cable systems, the conductivity of the extruded insulation material needs to be considered. The maximum allowed conductivity is selected based on the intended electrical field and the insulation thickness. For cost reasons the insulation thickness is minimized. Therefore, a high electrical field is desired.

Many attempts have been made to improve different qualities of insulation materials. For example, US2012/0171404 describes a method to decrease conductivity in insulation material by decreasing the amount of peroxide in insulation material. However, if the concentration of peroxide is too low the polyethylene will not be cross-linked properly.

However, sulphur containing antioxidants, like 4,4"-thio-bis (2-tertbutyl-5-methylphenol) (TTM), contain phenols groups. Peroxides, such as dicumyl peroxide, react with these phenols. As a consequence, through the addition of TTM, not enough peroxide may be available for crosslinking the olefin polymer.

The conductivity of insulation material is important because the conductivity for electrical transmission cable determines the leakage current and the heat generated by such a leakage. The conductivity is as low as possible. At the same time, the insulation material must be strong, flexible and have good low temperature impact strength.

SUMMARY

The present invention relates to a transmission cable comprising a conductor or a bundle of conductors extending along a longitudinal axis, which is circumferentially covered by an insulation layer comprising an extruded insulation material, whereby the transmission cable passes the electrical type test as specified in Cigré TB496, whereby the rated voltage is 450 kV, or more. In one embodiment, $U_0$ is 525 kV, or more.

By the invention is obtained a transmission cable comprising a conductor, which is circumferentially covered by an insulation layer, whereby the extruded insulation material has a reduced conductivity and provides a reduced total transmission loss. A transmission cable comprising extruded insulation material for electrical transmission cables, which has a required strength, flexibility and low-temperature impact strength is also obtained. One object of the invention is to provide a transmission cable that can be used in HV transmission cables in order to transmit power with high capacity over long distances. Another object is to improve the reliability of transmission cables and to decrease aging and manufacturing costs for insulated transmission cables. A further object is to provide a transmission cable comprising extruded insulation material that can handle a higher working temperature, for example a temperature of up to about 90° C. One object is to provide a transmission cable that has an improved power transmission capacity, whereby beside the higher working temperature, also the breakdown strength and electrical field stress distribution of the extruded insulation material can be improved. An object is to provide a HVDC cable having extruded insulation material that enables an increase of voltage level without any need for increasing the dimensions of the cable.

The transmission cable according to the invention can be used in HV transmission cables. The transmission cable allows for higher working temperature, such as temperatures up to or over 90° C. Also, the breakdown strength and electrical field stress distribution of the transmission cable are improved. No voids appear in the extruded insulation material after use in a transmission cable at voltages over 320 kV. A transmission cable according to the invention can be used in high voltage and extra/ultra high voltage DC-transmission cable systems, whereby the voltage is 450 kV or more, or 500 kV or more, or 600 kV or more, or even 800 kV or more. In one embodiment, the rated voltage is 525 kV, or more.

In one embodiment, the transmission cable comprises concentrically arranged:

- an inner electrical conductor,
- a first semiconducting layer circumferentially covering the conductor,
- a layer of electrical insulation layer comprising extruded insulation material circumferentially covering the first semiconducting layer,
- a second semiconducting layer circumferentially covering the first layer of polymer-based electrical insulator, and
- optionally a jacketing layer and armor covering the outer wall of the second semiconducting layer, whereby the transmission cable passes the electrical type test as specified in Cigré T13496, whereby the rated voltage is 450 kV, or more.

In one embodiment, the rated voltage is 525 kV, or more.

The transmission cable according to the invention may also comprise layers that are compatible with the insulation system with specific functions e.g. moisture barriers and other mechanical protective layers such as a jacketing layer and armoring covering the outer wall of the second semiconducting layer.

In another embodiment, the type test comprises subjecting the transmission cable to a DC voltage of substantially $1.85*U_0$ for at least 30 days, and wherein $U_0$ is 450 kV, or more. In one embodiment, $U_0$ is 525 kV, or more.

During the load cycle test, the transmission cable is subjected to a DC voltage during cycles at negative polarity followed by cycles at positive polarity. A DC voltage of $1.85*U_0$ may be used, wherein $U_0$ as defined above, for example 450 kV, or 525 kV, or above 450 kV, or between 450 and 1200 kV, for example at a voltage of 475, or 500, or 550, or 600, or 850 kV.

The number of cycles may vary from 5 to 25, or 5 to 20, or 10 to 25, or 10 to 15 cycles at negative or positive polarity. The same number of cycles may be used for both polarities.

Cycles at negative polarity followed by cycles at positive polarity may be followed by additional cycles at positive polarity, wherein the DC voltage is as defined above. The number of cycles used during the last positive polarity measurements may be less than the number of cycles used for the negative and/or positive cycles mentioned above. The number of cycles may be 1 to 20, or 1 to 10, or 5 to 10.

The same DC voltage may be used at all three polarities during one load cycle test.

The additional cycles at positive polarity may be performed during at least 1 to 25, or 4 to 15 days.

In yet another embodiment, the load cycle test comprises a rest period of at least 72, or 48, or 24, or 12, or 10, or 8, or 6 hours between the blocks of different polarities. For example, the step of cycles at negative polarity may optionally be followed by a rest period of at least 6 to 10 hours. The rest period may be without voltage and the cable may be heated during the rest period.

In one embodiment, the type test comprises subjecting the transmission cable to a DC voltage of $1.85*U_0$ during 5 to 25 cycles at negative polarity, followed by a polarity reversal with another 5 to 25 cycles at positive polarity at a DC voltage of $1.85*U_0$, followed by additional 2 to 15 cycles during at least 4 to 15 days at positive polarity, and wherein $U_0$ is 450 kV, or more. In one embodiment, $U_0$ is 525 kV, or more. The type test, which includes the load cycle test, may comprise a rest period of at least 6 to 10 hours between the blocks of different polarities.

In one embodiment, the same number of cycles are used for both the negative and positive cycles. In another embodiment, the number of cycles used during the last positive polarity measurements is less than the number of cycles used for the first negative and/or positive cycles. In one embodiment, the additional cycles at positive polarity is performed during at least 1 to 25, or 4 to 15 days. In yet another embodiment, the same DC voltage is used at all three polarities during one load cycle test.

In a further embodiment, the type test comprises subjecting the transmission cable to a DC voltage of $1.85*U_0$ during 10 to 15 cycles at negative polarity, followed by a polarity reversal with another 10 to 15 cycles at positive polarity at a DC voltage of $1.85*U_0$, followed by additional 2 to 5 cycles during at least 4 to 10 days at positive polarity, and wherein $U_0$ is 450 kV, or more. In one embodiment, $U_0$ is 525 kV, or more. The type test, which includes the load cycle test, may comprise a rest period of at least 8 hours between the blocks of different polarities.

In one embodiment, the same number of cycles are used for both the negative and positive cycles. In another embodiment, the number of cycles used during the last positive polarity measurements is less than the number of cycles used for the first negative and/or positive cycles. In one embodiment, the additional cycles at positive polarity is performed during at least 1 to 25, or 4 to 15 days. In yet another embodiment, the same DC voltage is used at all three polarities during one load cycle test.

In a further embodiment, the type test comprises subjecting the power cable that comprises the extruded insulation material to a DC voltage of $1.85*U_0$ during 12 cycles at negative polarity, followed by a polarity reversal with another 12 cycles at positive polarity at a DC voltage of $1.85*U_0$, followed by additional 3 cycles during at least 6 days at positive polarity, and wherein $U_0$ is between 450 and 1200 kV. Ur, is for example the same at both polarities.

In another embodiment $U_0$ is between 450 and 1200 kV. In a further embodiment $U_0$ is between 450 and 850, or between 450 and 650 kV. $U_0$ is for example between 450 and 1200 kV or between 525 and 850 kV or between 525 and 650 kV. The type test, which includes the load cycle test, may comprise a rest period of at least 8 hours between the blocks of different polarities.

In one embodiment, the same number of cycles are used for both the negative and positive cycles. In another embodiment, the number of cycles used during the last positive polarity measurements is less than the number of cycles used for the first negative and/or positive cycles. In one embodiment, the additional cycles at positive polarity is performed during at least 1 to 25, or 4 to 15 days. In yet another embodiment, the same DC voltage is used at all three polarities during one load cycle test.

In one embodiment, $U_0$ is above 450, 500, 525, 550, 575, 600, 650, 700, 800, 900, 1000, 1100 and/or 1200 kV. In one embodiment, $U_0$ is above 525 kV.

In another embodiment, the conductivity of the extruded insulation material at 30 kV/mm and 70° C. is between 0.01 and 60 fS/m. The conductivity has been measured according to the DC conductivity method as described under "Determination Methods".

The conductivity of the extruded insulation material at 30 kV/mm and 70° C. is between 0.01 and 60 fS/m. The conductivity is for example between 0.001 and 50, or between 0.001 and 35 fS/m, or between 0.001 and 15 fS/m, or between 0.000001 and 6.5 fS/m. The same result can be obtained without using degassing.

In one embodiment, the extruded insulation material comprises a crosslinked polymer composition, which is obtained by crosslinking a polymer composition, which polymer comprises a polyolefin, peroxide and sulphur containing antioxidant, wherein the crosslinked polymer composition has an Oxidation Induction Time, determined according to ASTM-D3895, ISO/CD 11357 and EN 728 using a Differential Scanning calorimeter (DSC), which Oxidation Induction Time corresponds to Z minutes, and comprises an amount of peroxide by-products which corresponds to W ppm determined according to BTM2222 using HPLC, wherein $$Z_1 \leq Z \leq Z_2,\ W_1 \leq W \leq W_2, \text{ and}$$

$$W \leq p - 270*Z, \text{ wherein}$$

$Z_1$ is 0, $Z_2$ is 60, $W_1$ is 0 and $W_2$ is 9500, and p is 18500.

In another embodiment $Z_1$ is 2, $Z_2$ is 20, $W_2$ is 9000, and p is 16000.

In a further embodiment the extruded insulation material comprises one or more polyolefin, one or more peroxide based cross-linking agent, and one or more sulphur containing antioxidant agent.

In one embodiment, the polyolefin is a polyethylene polymer or copolymer or a low density polyethylene polymer or copolymer.

In another embodiment, the peroxide based cross-linking agent is dicumyl peroxide.

In a further embodiment, the extruded insulation material further comprises one or more additives selected from colour pigment, filler, stabilizer, UV-absorbers, anti-statics, lubricant and/or silane.

The present invention also relates to a method for preparing a transmission cable, as defined above, comprising the steps of providing at least one polymer-based electrical insulation layer comprising an extruded insulation material, which is crosslinkable, such that the insulation layer circumferentially covers a conductor; and curing the insulation layer, whereby the extruded insulation material is crosslinked.

In one embodiment, the method comprises curing the insulation layer by exposing the insulation layer to a maximum temperature of 280° C. or less.

In a further embodiment, the method comprises curing the insulation layer by exposing the insulation layer to a maximum temperature of 250° C. or less, 225° C. or less, 180° C. or less or 160° C. or less.

In one embodiment of the method, the insulation layer is provided on the conductor by extrusion.

According to another embodiment, the method comprises the steps extruding a first semiconductive layer circumferentially covering the conductor;

extruding the insulation layer circumferentially covering the first semiconductive layer; and extruding a second semiconductive layer circumferentially covering the insulation layer, and curing the extruded insulation layer and the extruded first and second semiconductive layers, by exposing the insulation layer and the first and second semiconductive layers to a maximum temperature of 280° C. or less.

The above mentioned embodiments can be combined in any suitable way.

DETAILED DESCRIPTION

The transmission cable of the invention passes the requirements of the electrical type test as specified in Cigré TB496. The transmission cable fulfils especially the requirements of the electrical type test as specified in Cigré TB496, chapter 4, or more specifically as specified in Cigré TB496, chapter 4, § 4.4.2 and/or § 4.4.3.

The transmission cable of the present invention may be used in any direct or alternating current (DC or AC). The transmission cable of the present invention is especially suitable for use in high and ultra-high voltage DC ((U) HVDC) transmission cables.

Figure 1:
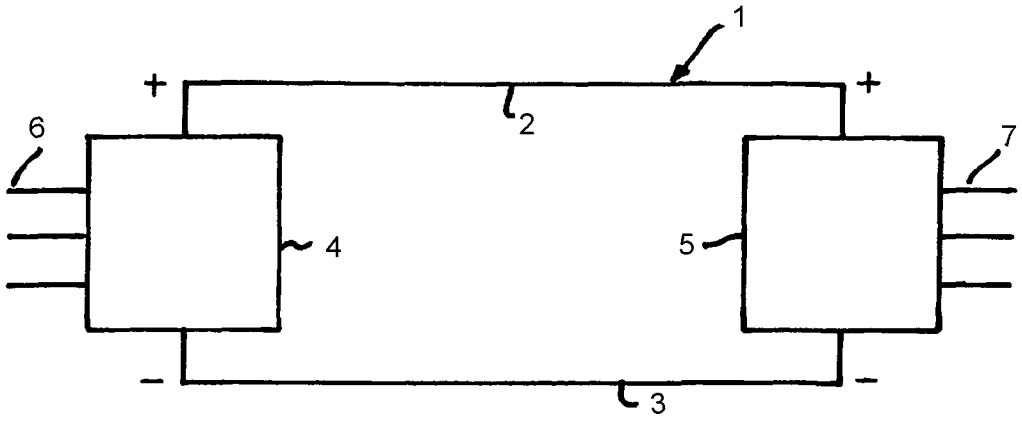
FIG. 1 shows a schematic block diagram of a power plant.
Figure 2:
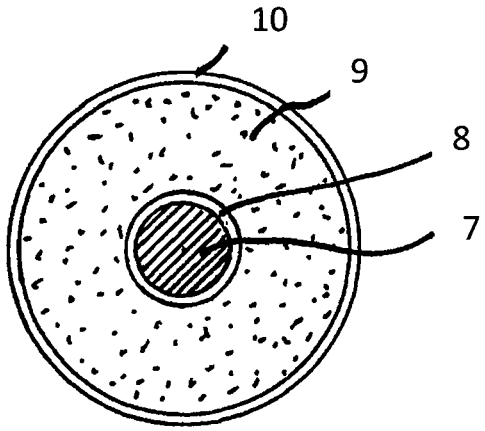
FIG. 2 shows an illustration of a cross-section of an HV cable.

FIG. 2 shows a typical transmission cable that comprises a conductor 7 or a bundle of conductors extending along a longitudinal axis, which is circumferentially covered by an insulation layer 9 that comprises extruded insulation material. The insulation layer 9 may be covered by a screen and/or sheath.

Figure 3:
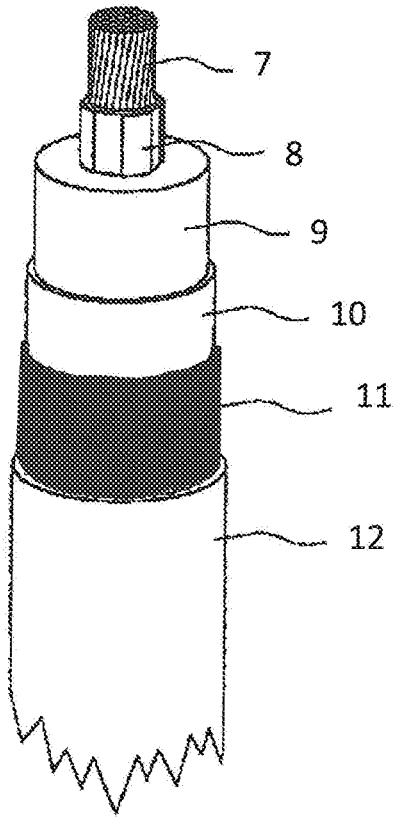
FIG. 3 shows an illustration of an HV cable.
Figure 4:
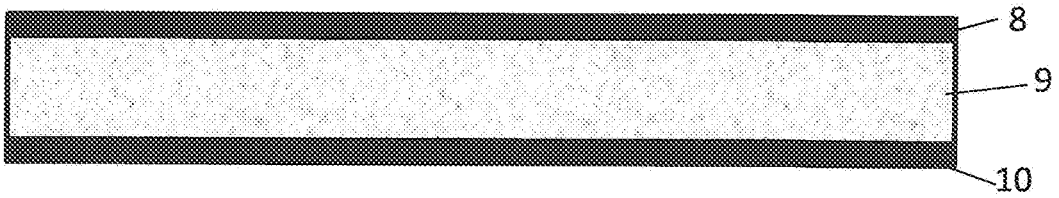
FIG. 4 shows an illustration of a longitudinal section of an HV cable.

As illustrated in FIG. 3, in a typical transmission cable, such as an HVDC cable, the conductor 7 may be circumferentially covered by an inner or first semiconductive layer 8, which layer is then covered by the insulation layer 9. The insulation layer 9 may be circumferentially covered by an outer or second semiconductive layer 10. The outer semiconductive layer 10 may be covered by a screen and/or sheath 11, which may be lead or another metal. This screen and/or sheath 11 may be further covered by a protection layer 12 that may also have insulation and mechanical properties such as a plastic or rubber material.

The transmission cable comprises a crosslinked polymer composition, which is obtained by crosslinking a polymer composition. The polymer composition comprises a polyolefin, peroxide and sulphur containing antioxidant.

The crosslinked polymer composition has an Oxidation Induction Time, determined according to ASTM-D3895, ISO/CD 11357 and EN 728 using a Differential Scanning calorimeter (DSC), which Oxidation Induction Time corresponds to Z minutes, and comprises an amount of peroxide by-products which corresponds to W ppm determined according to BTM2222 using HPLC, wherein $$Z_1 \leq Z \leq Z_2,\ W_1 \leq W \leq W_2, \text{ and}$$

$$W \leq p - 270 * Z, \text{ wherein}$$

$Z_1$ is 0, $Z_2$ is 60, $W_1$ is 0 and $W_2$ is 9500, and p is 18500.

Alternatively, $Z_1$ may be 2. $Z_2$ may be 20. $W_2$ may be 9000. p may be 16000.

A further embodiment of the present invention discloses an extruded insulation material being defined as described herein, and which extruded insulation material is further comprised in a transmission cable in accordance with the present invention and as described herein.

The Oxidation Induction Time method, determined according to ASTM-D3895, ISO/CD 11357 and EN 728 using a Differential Scanning calorimeter (DSC), is described under "Determination Methods".

The amount of peroxide by-products which corresponds to W ppm determined according to BTM2222 using HPLC.

The extruded insulation material may further comprise one or more additives selected from colour pigment, filler, stabilizer, UV-absorbers, anti-statics, lubricant, silane, and the like.

The filler may be micro- or nano-fillers, i.e. fillers with an average particle diameter in nano-meters or micrometers. Suitably, nano-fillers are used. Examples of such fillers are polyhedral oligomeric silsesquioxanes (POSS), or metal oxides such as oxides, dioxides or trioxides of calcium, zinc, silicon, aluminium, magnesium and titanium. Other fillers are $CaCO_3$ and nanoclay. Mixtures of one or more fillers may also be used. Preferred fillers are polyhedral oligomeric silsesquioxanes (POSS®), MgO, $SiO_{1-2}$, $Al_2O_3$, $TiO_2$, CaO, carbon black, $CaCO_3$ and nanoclay, or mixtures thereof. Another preferred filler is silicon dioxide. The fillers may be crystalline or amorphous or mixtures thereof. In an embodiment, the fillers are amorphous. The fillers may be present in an amount between 0.01 and 10 wt % of the total weight of the extruded insulation material.

The amount of filler is between 0.5 and 10 wt %, or 1 and 10 wt % of the total weight of the polymer-based composition.

The material comprised in the first and second semiconductive layers may comprise an olefin polymer, e.g. polyethylene, together with one or more conductive filler, such as carbon black.

The density of the obtained extruded insulation material is, for example, between 900 and 950 kg/m$^3$, or 915 and 935 kg/m$^3$, or about 923 kg/m$^3$.

The crystallinity of the obtained extruded insulation material is, for example, between 20 and 70%, or between 35 and 55%, or between 40 and 50%, The melting point of the obtained extruded insulation material is, for example, between 90 and 130° C., or between 100 and 120° C., or about 110° C.

The oxidation Induction Time (OIT) as determined according to ISO 11357-6:2008(E) is, for example, between 5 and 10, or between 6 and 8 minutes, or about 7 minutes as measured on the crosslinked formulation.

EXPERIMENTAL

Determination Methods

Unless otherwise stated in the description or experimental part the following methods were used for the property determinations. Weight percentages (wt %) are defined as percentage of the total weight of the polymer-based composition.

Oxidation Induction Time (OIT) Method

The OIT test is performed according to ASTM-D3895, ISO/CD 11357 and EN 728 using a Differential Scanning calorimeter (DSC). A circular sample with a diameter of 5 mm and a weight of 5-6 mg of the material (i.e. the crosslinked polymer composition of the present invention) to be tested is introduced into the DSC at room temperature, and the sample is heated to 200° C. (20° C./min in nitrogen atmosphere. After 5 min stabilisation isothermally at 200° C., the gas is changed from nitrogen to oxygen. The flow rate of oxygen is the same as nitrogen, 50 ml/min. Under these conditions the stabiliser is consumed over time until it is totally depleted. At this point the polymer sample (i.e. the crosslinked polymer composition of the present invention) degrades or oxidizes liberating additional heat (exothermal reaction).

The Oxidation Induction Time (OIT) is defined as the time measured from the oxygen switch on to the onset inflection point for the exothermal reaction occurring when the stabiliser is depleted. Thus, OIT is a measure of the thermal stability of the material. Parallel measurements are performed for each condition and mean value is calculated.

Method for Measuring Peroxide by-Products with HPLC

The peroxide by-products are measured according to BTM2222:

Approximately 1 g of a ~1 mm thick compression moulded plaque is immersed in a 1:1 (weight) mixture of isopropanol and cyclohexane for 2 h at 72° C. After filtering, 10 μL are injected on a C18-HPLC column e.g. Zorbax C18-SB (150×4.6 mm). The peroxide by-products are separated using the following gradient:

| Time min. | Flow ml | Water % | Acetonitrile % |
|---|---|---|---|
| 0.0 | 1.0 | 60 | 40 |
| 8.0 | 1.0 | 60 | 40 |

-continued

| Time min. | Flow ml | Water % | Acetonitrile % |
|---|---|---|---|
| 15.0 | 1.0 | 0 | 100 |
| 20.0 | 1.0 | 0 | 100 |
| 22.0 | 1.0 | 60 | 40 |
| 29.0 | 1.0 | 60 | 40 |

A UV-detector records the signals at 200 nm. Quantification of the individual substances, such as dicumyl peroxide and the byproducts: acetophenone, cumylalcohol and α-methylstyrene, is based on external calibration using peak areas.

Melt Flow Rate

The melt flow rate (MFR) is determined according to ISO 1133 and is indicated in g/10 min. The MFR is an indication of the flowability, and hence the processability, of the polymer. The higher the melt flow rate, the lower the viscosity of the polymer. The MFR is determined at 190 C for polyethylenes and may be determined at different loadings such as 2.16 kg ($MFR_2$) or 21.6 kg ($MFR_{21}$).

Density

The density was measured according to ISO 1183-2. The sample preparation was executed according to ISO 1872-2 Table 3 Q (compression moulding).

Comonomer Contents a) Quantification of Alpha-Olefin Content in Linear Low Density Polyethylenes and Low Density Polyethylenes by NMR Spectroscopy:

The comonomer content was determined by quantitative 13C nuclear magnetic resonance (NMR) spectroscopy after basic assignment (J. Randall JMS—Rev. Macromol. Chem. Phys., C29(2&3), 201-317 (1989)). Experimental parameters were adjusted to ensure measurement of quantitative spectra for this specific task.

Specifically solution-state NMR spectroscopy was employed using a Bruker Avancelll 400 spectrometer. Homogeneous samples were prepared by dissolving approximately 0.200 g polymer in 2.5 ml of deuterated-tetrachloroethene in 10 mm sample tubes utilising a heat block and rotating tube oven at 140° C. Proton decoupled 13C single pulse NMR spectra with NOE (Nuclear Overhauser Effect) (power gated) were recorded using the following acquisition parameters: a flip-angle of 90 degrees, 4 dummy scans, 4096 transients an acquisition time of 1.6 s, a spectral width of 20 kHz, a temperature of 125° C., a bilevel WALTZ proton decoupling scheme and a relaxation delay of 3.0 s. The resulting FID (free induction decay) was processed using the following processing parameters: zero-filling to 32 k data points and apodisation using a gaussian window function; automatic zeroth and first order phase correction and automatic baseline correction using a fifth order polynomial restricted to the region of interest.

Quantities were calculated using simple corrected ratios of the signal integrals of representative sites based upon methods well known in the art.

b) Comonomer Content of Polar Comonomers in Low Density Polyethylene (1) Polymers Containing >6 wt % Polar Comonomer Units Comonomer content (wt %) was determined in a known manner based on Fourier transform infrared spectroscopy (FTIR) determination calibrated with quantitative nuclear magnetic resonance (NMR) spectroscopy. Below is exemplified the determination of the polar comonomer content of ethylene ethyl acrylate, ethylene butyl acrylate and ethylene methyl acrylate. Film samples of the polymers were prepared for the FTIR measurement: 0.5-0.7 mm thickness was used for ethylene butyl acrylate and ethylene ethyl acrylate and 0.10 mm film thickness for ethylene methyl acrylate in an amount of >6 wt %. Films were pressed using a Specac film press at 150° C., approximately at 5 tons, 1-2 minutes, and then cooled with cold water in a non-controlled manner. The accurate thickness of the obtained film samples was measured.

After the analysis with FTIR, base lines in absorbance mode were drawn for the peaks to be analysed. The absorbance peak for the comonomer was normalised with the absorbance peak of polyethylene (e.g. the peak height for butyl acrylate or ethyl acrylate at 3450 $cm^{-1}$ was divided with the peak height of polyethylene at 2020 $cm^{-1}$). The NMR spectroscopy calibration procedure was undertaken in the conventional manner, which is well documented in the literature, explained below.

For the determination of the content of methyl acrylate a 0.10 mm thick film sample was prepared. After the analysis, the maximum absorbance for the peak for the methylacrylate at 3455 $cm^{-1}$ was subtracted with the absorbance value for the base line at 2475 $cm^{-1}$ ($A_{methylacrylate}-A_{2475}$). Then the maximum absorbance peak for the polyethylene peak at 2660 $cm^{-1}$ was subtracted with the absorbance value for the base line at 2475 $cm^{-1}$ ($A_{2660}-A_{2475}$). The ratio between ($A_{methylacrylate}$-$A_{2475}$) and ($A_{2660}$-$A_{2475}$) was then calculated in the conventional manner, which is well documented in the literature.

The weight-% can be converted to mol-% by calculation. This conversion is well documented in the literature.

Quantification of Copolymer Content in Polymers by NMR Spectroscopy.

The comonomer content was determined by quantitative nuclear magnetic resonance (NMR) spectroscopy after basic assignment (e.g. "NMR Spectra of Polymers and Polymer Additives", A. J. Brandolini and D. D. Hills, 2000, Marcel Dekker, Inc. New York). Experimental parameters were adjusted to ensure measurement of quantitative spectra for this specific task (e.g. "200 and More NMR Experiments: A Practical Course", S. Berger and S. Braun, 2004, Wiley-VCH, Weinheim). Quantities were calculated using simple corrected ratios of the signal integrals of representative sites in a manner known in the art.

(2) Polymers Containing 6 wt % or Less Polar Comonomer Units

Comonomer content (wt %) was determined in a known manner based on Fourier transform infrared spectroscopy (FTIR) determination calibrated with quantitative nuclear magnetic resonance (NMR) spectroscopy. Below is exemplified the determination of the polar comonomer content of ethylene butyl acrylate and ethylene methyl acrylate. For the FTIR measurement a film samples of 0.05 to 0.12 mm thickness were prepared as described above under method (1). The accurate thickness of the obtained film samples was measured. After the analysis with FTIR base lines in absorbance mode were drawn for the peaks to be analysed. The maximum absorbance for the peak for the comonomer (e.g. for methylacrylate at 1164 $cm^{-1}$ and butylacrylate at 1165 $cm^{-1}$) was subtracted with the absorbance value for the base line at 1850 $cm^{-1}$ ($A_{polar\ comonomer}-A_{1850}$). Then, the maximum absorbance peak for polyethylene peak at 2660 $cm^{-1}$ was subtracted with the absorbance value for the base line at 1850 $cm^{-1}$ ($A_{2660}-A_{1850}$). The ratio between ($A_{comonomer}-A_{1850}$) and ($A_{2660}-A_{1850}$) was then calculated. The NMR spectroscopy calibration procedure was undertaken in the conventional manner, which is well documented in the literature, as described above under method (1).

The weight-% can be converted to mol-% by calculation. This conversion is well documented in the literature.

Crystallinity and melting temperature was measured with DSC using a TA Instruments Q2000. The temperature program used is starting at 30° C., heating to 180° C., an isotherm at 180° C. for 2 min and then cooling to −15C, an isotherm at −15° C. for 2 min and then heating to 180° C. The heating and cooling rates are 10° C./min.

Samples which are cross linked are all cross-linked at 180° C. for 10 min and then degassed in vacuum at 70° C. overnight to remove all peroxide by-products before the crystallinity and melt temperature are measured.

Melting temperature, Tm, is the temperature where the heat flow to the sample is at its maximum.

The degree of crystallinity, Crystallinity %=100×ΔHf/ΔH 100% where ΔH100% (J/g) is 290.0 for PE (L. Mandelkem, Macromolecular Physics, Vol. 1-3, Academic Press, New York 1973, 1976 &1980) The evaluation of crystallinity is done from 20° C.

DC Conductivity Method

The plaques are compression moulded from pellets of the test polymer composition. The final plaques consist of the test polymer composition and have a thickness of 1 mm and a diameter of 260 mm.

The final plaques are prepared by press-moulding at 130° C. for 600 s and 20 MPa. Thereafter, the temperature is increased and reaches 180° C., or 250° C., after 5 min. The temperature is then kept constant at 180° C., or 250° C., for 1000 s during which the plaque becomes fully crosslinked by means of the peroxide present in the test polymer composition. Finally, the temperature is decreased using the cooling rate 15° C./min until room temperature is reached when the pressure is released.

A high voltage source is connected to the upper electrode to apply voltage over the test sample. The resulting current through the sample is measured with an electrometer/picoammeter. The measurement cell is a three electrodes system with brass electrodes placed in a heating oven circulated with dried compressed air to maintain a constant humidity level.

The diameter of the measurement electrode is 100 mm. Precautions have been taken to avoid flashovers from the round edges of the electrodes.

The applied voltage is 30 kV DC meaning a mean electric field of 30 kV/mm. The temperature is 70° C. The current through the plaque is logged throughout the whole experiments lasting for 24 hours. The current after 24 hours is used to calculate the conductivity of the insulation.

This method and a schematic picture of the measurement setup for the conductivity measurements has been thoroughly described in publications presented at Nordic Insulation Symposium 2009 (Nord-IS 09), Gothenburg, Sweden, Jun. 15-17, 2009, page 55-58: Olsson et al, "Experimental determination of DC conductivity for XLPE insulation".

Nordic Insulation Symposium 2013 (Nord-IS 13), Trondheim, Norway, Jun. 9-12, 2013, page 161-164: Andersson et al, "Comparison of test setups for high field conductivity of HVDC insulation materials".

Method for Determination of the Amount of Double Bonds in the Polymer Composition or in the Polymer.

A) Quantification of the Amount of Carbon-Carbon Double Bonds by IR Spectroscopy Quantitative infrared (IR) spectroscopy was used to quantify the amount of carbon-carbon doubles (C=C) bonds.

Calibration was achieved by prior determination of the molar extinction coefficient of the C═C functional groups in representative low molecular weight model compounds of known structure.

The amount of each of these groups (N) was defined as number of carbon-carbon double bonds per thousand total carbon atoms (C═C/1000C) via:

$$N=(A\times 14)/(E\times L\times D)$$

where A is the maximum absorbance defined as peak height, E the molar extinction coefficient of the group in question ($l\cdot mol^{-1}\cdot mm^{-1}$), L the film thickness (mm) and D the density of the material ($g\cdot cm^{-1}$).

The total amount of C═C bonds per thousand total carbon atoms can be calculated through summation of N for the individual C═C containing components. For polyethylene samples solid-state infrared spectra were recorded using a FTIR spectrometer (Perkin Elmer 2000) on compression moulded thin (0.5-1.0 mm) films at a resolution of 4 $cm^{-1}$ and analysed in absorption mode.

All quantification was undertaken using the absorption of the C═C—H out-of-plain bend between 910 and 960 $cm^{-1}$. The specific wave number of the absorption was dependent on the chemical structure of the unsaturation containing species.

1) Polymer Compositions Comprising Polyethylene Homopolymers and Copolymers, Except Polyethylene Copolymers with >0.4 wt % Polar Comonomer For polyethylenes three types of C═C containing functional groups were quantified, each with a characteristic absorption and each calibrated to a different model compound resulting in individual extinction coefficients:

- vinyl (R—CH═CH2) via 910 $cm^{-1}$ based on 1-decene [dec-1-ene] giving E=13.13 $l\cdot mol^{-1}$ $mm^{-1}$
- vinylidene (RR'C═CH2) via 888 $cm^{-1}$ based on 2-methyl-1-heptene [2-methyhept-1-ene] giving E=18.24 $l\cdot mol^{-1}\cdot mm^{-1}$
- trans-vinylene (R—CH═CH—R') via 965 $cm^{-1}$ based on trans-4-decene [(E)-dec-4-ene] giving E=15.14 $l\cdot mol^{-1}\text{-}mm^{-1}$ For polyethylene homopolymers or copolymers with <0.4 wt % of polar comonomer linear baseline correction was applied between approximately 980 and 840 $cm^{-1}$.

2) Polymer Compositions Comprising Polyethylene Copolymers with >0.4 wt % Polar Comonomer For polyethylene copolymers with >0.4 wt % of polar comonomer two types of C═C containing functional groups were quantified, each with a characteristic absorption and each calibrated to a different model compound resulting in individual extinction coefficients:

- vinyl (R—CH═CH2) via 910 $cm^{-1}$ based on 1-decene [dec-1-ene] giving E=13.13 $l\cdot mol^{-1}\cdot mm^{-1}$
- vinylidene (RR'C═CH2) via 888 $cm^{-1}$ based on 2-methyl-1-heptene [2-methyhept-1-ene] giving E=18.24 $l\cdot mol^{-1}\cdot mm^{-1}$

EBA:

For poly(ethylene-co-butylacrylate) (EBA) systems linear baseline correction was applied between approximately 920 and 870 $cm^{-1}$.

EMA:

For poly(ethylene-co-methylacrylate) (EMA) systems linear baseline correction was applied between approximately 930 and 870 $cm^{-1}$.

3) Polymer Compositions Comprising Unsaturated Low Molecular Weight Molecules

For systems containing low molecular weight C═C containing species direct calibration using the molar extinction coefficient of the C═C absorption in the low molecular weight species itself was undertaken.

B) Quantification of Molar Extinction Coefficients by IR Spectroscopy

The molar extinction coefficient was determined according to the procedure given in ASTM D3124-98 and ASTM D6248-98. Solution-state infrared spectra were recorded using a FTIR spectrometer (Perkin Elmer 2000) equipped with a 0.1 mm path length liquid cell at a resolution of 4 $cm^{-1}$.

The molar extinction coefficient (E) was determined as $l\cdot mol\cdot^{-1}\cdot mm^{-1}$ via:

$$E=A/(C\times L)$$

where A is the maximum absorbance defined as peak height, C the concentration ($mol\cdot l^{-1}$) and L the cell thickness (mm).

At least three 0.18 $mol\cdot l^{-1}$ solutions in carbondisulphide ($CS_2$) were used and the mean value of the molar extinction coefficient determined. For α,ω-divinylsiloxanes, the molar extinction coefficient was assumed to be comparable to that of <insert small molecule here>.

An alternative description of a method for determination of the amount of double bonds in the Polymer Composition or in the polymer.

Quantification of the Amount of Carbon-Carbon Double Bonds by IR Spectroscopy

Quantitative infrared (IR) spectroscopy was used to quantify the amount of carbon-carbon double bonds (C═C). Specifically solid-state transmission FTIR spectroscopy was used (Perkin Elmer 2000). Calibration was achieved by prior determination of the molar extinction coefficient of the C═C functional groups in representative low molecular weight model compounds of know structure. The amount of a given C═C functional group containing species (N) was defined as number of carbon-carbon double bonds per thousand total carbon atoms (C═C/1000C) according to:

$$N=(A\times 14)/(E\times L\times D)$$

where A is the maximum absorbance defined as peak height, E the molar extinction coefficient of the group in question ($l\cdot mol^{-1}\cdot mm^{-1}$), L the film thickness (mm) and D the density of the material ($g\cdot cm^{-1}$).

For systems containing unsaturation three types of C═C containing functional groups were considered, each with a characteristic C═C—H out-of-plain bending vibrational mode, and each calibrated to a different model compound resulting in individual extinction coefficients:

- vinyl (R—CH═CH2) via at around 910 $cm^{-1}$ based on 1-decene [dec-1-ene] giving E=13.13 $l\cdot mol^{-1}$ $mm^{-1}$
- vinylidene (RR'C═CH2) at around 888 $cm^{-1}$ based on 2-methyl-1-heptene [2-methyhept-1-ene] giving E=18.24 $l\cdot mol^{-1}\cdot mm^{-1}$
- trans-vinylene (R—CH═CH—R') at around 965 $cm^{-1}$ based on trans-4-decene [(E)-dec-4-ene] giving E=15.14 $l\cdot mol^{-1}\cdot mm^{-1}$ The specific wavenumber of this absorption was dependent on the specific chemical structure of the species. When non-aliphatic unsaturated group were addressed the molar extinction coefficient was taken to be the same as that of their related aliphatic unsaturated group, as determined using the aliphatic small molecule analogue.

The molar extinction coefficient was determined according to the procedure described in ASTM D3124-98 and ASTM D6248-98. Solution-state infrared spectra were recorded on standard solutions using a FTIR spectrometer (Perkin Elmer 2000) equipped with a 0.1 mm path length liquid cell at a resolution of 4 $cm^{-1}$. The molar extinction coefficient (E) was determined as $l \cdot mol^{-1} \cdot mm^{-1}$ via:

$$E=A/(C \times L)$$

where A is the maximum absorbance defined as peak height, C the concentration ($mol \cdot l^{-1}$) and L the cell thickness (mm). At least three 0.18 $mol \cdot l^{-1}$ solutions in carbondisulphide ($CS_2$) were used and the mean value of the molar extinction coefficient determined.

Experimental Part

Preparation of Polymers of the Examples of the Present Invention and the Comparative Example All polymers were low density polyethylenes produced in a high pressure reactor. As to CTA (chain transfer agent) feeds, e.g. the PA (propion aldehyde) content can be given as liter/hour or kg/h and converted to either units using a density of PA of 0.807 kg/liter for the recalculation.

LDPE1:

Ethylene with recycled CTA was compressed in a 5-stage precompressor and a 2-stage hyper compressor with intermediate cooling to reach initial reaction pressure of ca 2628 bar (262.8 MPa). The total compressor throughput was ca 30 tons/hour. In the compressor area approximately 4.9 liters/hour of propion aldehyde (PA, CAS number: 123-38-6) was added together with approximately 81 kg propylene/hour as chain transfer agents to maintain an MFR of 1.89 g/10 min. Here, also 1,7-octadiene was added to the reactor in an amount of 27 kg/h. The compressed mixture was heated to 157° C. in a preheating section of a front feed two-zone tubular reactor with an inner diameter of ca 40 mm and a total length of 1200 meters. A mixture of commercially available peroxide radical initiators dissolved in isododecane was injected just after the preheater in an amount sufficient for the exothermal polymerisation reaction to reach peak temperatures of ca 275° C. after which it was cooled to approximately 200° C. The subsequent 2nd peak reaction temperature was 264'C. The reaction mixture was depressurised by a kick valve, cooled and polymer was separated from unreacted gas.

LDPE2:

Ethylene with recycled CTA was compressed in a 5-stage precompressor and a 2-stage hyper compressor with intermediate cooling to reach initial reaction pressure of ca 2904 bar (290.4 MPa). The total compressor throughput was ca 30 tons/hour. In the compressor area approximately 105 kg propylene/hour was added as chain transfer agents to maintain an MFR of 1.89 g/10 min. Here, also 1,7-octadiene was added to the reactor in an amount of 62 kg/h. The compressed mixture was heated to 159° C. in a preheating section of a front feed three-zone tubular reactor with an inner diameter of ca 40 mm and a total length of 1200 meters. A mixture of commercially available peroxide radical initiators dissolved in isododecane was injected just after the preheater in an amount sufficient for the exothermal polymerisation reaction to reach peak temperatures of ca 289° C. after which it was cooled to approximately 210° C. The subsequent $2^{nd}$ and $3^{rd}$ peak reaction temperatures were 283° C. and 262° C., respectively, with a cooling step in between to 225° C. The reaction mixture was depressurised by a kick valve, cooled and polymer was separated from unreacted gas.

The components of the crosslinked polymer compositions of inventive examples (INV.Ex.) 1 to 9, reference example (Ref. Ex.) 1 (not crosslinked) and Ref. Ex. 2 to 9 (represents the prior art polymer composition crosslinked with a conventional amount of peroxide) and the properties and experimental results of the compositions are given in table 1. The used additives are commercially available:

Peroxide: DCP=dicumyl peroxide ((CAS no. 80-43-3)

Sulphur containing antioxidant: 4,4'-thiobis (2-tertbutyl-5-methylphenol) (CAS number: 96-69-5).

Additive: 2,4-Diphenyl-4-methyl-1-pentene (CAS-no. 6362-80-7).

The amount of DCP is given in mmol of the content of —O—O— functional group per kg polymer composition. The amounts are also given in brackets as weight % (wt %).

TABLE 1

The properties of the crosslinked compositions of the inventive and reference examples:

| | CROSSLINKED POLYMER COMPOSITION: | | | | | | |
|---|---|---|---|---|---|---|---|
| | Ref. Ex. 1 | Ref. Ex. 2 | Ref. Ex. 3 | Ref. Ex. 4 | Ref. Ex. 5 | Inv. Ex. 1 | Inv. Ex. 2 |
| Polyolefin | LDPE1 | LDPE1 | LDPE1 | LDPE1 | LDPE1 | LDPE1 | LDPE1 |
| DCP (wt %) | 0 | 0.55 | 0.55 | 0.55 | 0.55 | 0.55 | 0.55 |
| mmol of —O—O—/kg polymer composition | 0 | 20 | 20 | 20 | 20 | 20 | 20 |
| 4,4'-thiobis (2-tertbutyl-5-methylphenol) (sulphur containing antioxidant) (wt %) | 0.08 | 0.08 | 0.08 | 0.08 | 0.08 | 0.08 | 0.08 |
| mmol of phenolic —OH/kg polymer composition | 4.5 | 4.5 | 4.5 | 4.5 | 4.5 | 4.5 | 4.5 |
| 2,4-Diphenyl-4-methyl-1-pentene (wt %) | 0 | 0.05 | 0.05 | 0.1 | 0.1 | 0 | 0 |
| Cross-linking temp [° C.] | 180 | 180 | 250 | 180 | 250 | 180 | 250 |
| Oxidation Induction Time, determined according to ASTM-D3895, ISO/CD 11357 AND EN 728 [minutes] | 80 | 22 | 41 | 33 | 50 | 7 | 11 |
| Amount of peroxide by-products [ppm] | 0 | 5500 | 5500 | 5500 | 5500 | 5500 | 5500 |
| Conductivity at 30 kV/mm and 70° C. (Not degassed) [fS/m] | 30 | 24 | 41 | 27 | 45 | 6.5 | 18 |

TABLE 1-continued

The properties of the crosslinked compositions of the inventive and reference examples:

| | CROSSLINKED POLYMER COMPOSITION: | | | | | | | |
|---|---|---|---|---|---|---|---|---|
| | Inv. Ex. 3 | Inv. Ex. 4 | Inv. Ex. 5 | Inv. Ex. 6 | Inv. Ex. 7 | Inv. Ex. 8 | Inv. Ex. 9 | Inv. Ex 10 |
| Polyolefin | LDPE2 | LDPE2 | LDPE2 | LDPE2 | LDPE2 | LDPE2 | LDPE2 | LDPE2 |
| DCP (wt %) | 0.3 | 0.5 | 0.7 | 0.9 | 0.3 | 0.5 | 0.7 | 0.9 |
| mmol of —O—O—/kg polymer composition | 11 | 19 | 26 | 33 | 11 | 19 | 26 | 33 |
| 4,4'-thiobis (2-tertbutyl-5-methylphenol) (sulphur containing antioxidant) (wt %) | 0.08 | 0.08 | 0.08 | 0.08 | 0.08 | 0.08 | 0.08 | 0.08 |
| mmol of phenolic —OH/kg polymer composition | 4.5 | 4.5 | 4.5 | 4.5 | 4.5 | 4.5 | 4.5 | 4.5 |
| 2,4-Diphenyl-4-methyl-1-pentene (wt %) | 0 | 0 | 0 | 0 | 0 | 0 | 0 | 0 |
| Cross-linking temp [° C.] | 180 | 180 | 180 | 180 | 250 | 250 | 250 | 250 |
| Oxidation Induction Time, determined according to ASTM-D3895, ISO/CD 11357 AND EN 728 [minutes] | 12 | 8 | 4 | 2 | 17 | 15 | 11 | 11 |
| Amount of peroxide by-products [ppm] | 3000 | 5000 | 7000 | 9000 | 3000 | 5000 | 7000 | 9000 |
| Conductivity at 30 kV/mm and 70° C. (Not degassed) [fS/m] | 5.3 | 8.3 | 8.6 | 11.4 | 7.9 | 14.5 | 19.5 | 25.8 |

| | CROSSLINKED POLYMER COMPOSITION: | | | | | |
|---|---|---|---|---|---|---|
| | Inv. Ex. 11 | Inv. Ex. 12 | Inv. Ex. 13 | Inv. Ex. 14 | Inv. Ex. 15 | Inv. Ex 16 |
| Polyolefin | LDPE1 | LDPE1 | LDPE1 | LDPE1 | LDPE1 | LDPE1 |
| DCP (wt %) | 0.5 | 0.7 | 0.9 | 0.5 | 0.7 | 0.9 |
| mmol of —O—O—/kg polymer composition | 19 | 26 | 33 | 19 | 26 | 33 |
| 4,4'-thiobis (2-tertbutyl-5-methylphenol) (sulphur containing antioxidant) (wt %) | 0.08 | 0.08 | 0.08 | 0.08 | 0.08 | 0.08 |
| mmol of phenolic —OH/kg polymer composition | 4.5 | 4.5 | 4.5 | 4.5 | 4.5 | 4.5 |
| 2,4-Diphenyl-4-methyl-1-pentene (wt %) | 0 | 0 | 0 | 0 | 0 | 0 |
| Cross-linking temp [° C.] | 180 | 180 | 180 | 250 | 250 | 250 |
| Oxidation Induction Time, determined according to ASTM-D3895, ISO/CD 11357 AND EN 728 [minutes] | 5 | 7 | 5 | 9 | 8 | 6 |
| Amount of peroxide by-products [ppm] | 5000 | 7000 | 9000 | 5000 | 7000 | 9000 |
| Conductivity at 30 kV/mm and 70° C. (Not degassed) [fS/m] | 6 | 11 | 9 | 15 | 22 | 26 |

| | CROSSLINKED POLYMER COMPOSITION: | | |
|---|---|---|---|
| | Inv. Ex. 17 | Ref. Ex. 6 | Inv. Ex. 18 |
| Polyolefin | LDPE1 | LDPE1 | LDPE1 |
| DCP (wt %) | 0.6 | 0.5 | 0.5 |
| mmol of —O—O—/kg polymer composition | 22 | 19 | 19 |
| 4,4'-thiobis (2-tertbutyl-5-methylphenol) (sulphur containing antioxidant) (wt %) | 0.05 | 0.05 | 0.05 |
| mmol of phenolic —OH/kg polymer composition | 2.8 | 2.8 | 2.8 |
| 2,4-Diphenyl-4-methyl-1-pentene (wt %) | 0 | 0.05 | 0 |
| Cross-linking temp [° C.] | 180 | 180 | 250 |
| Oxidation Induction Time, determined according to ASTM-D3895, ISO/CD 11357 AND EN 728 [minutes] | 6 | 12 | 14 |
| Conductivity at 30 kV/mm and 70° C. (Not degassed) [fS/m] | 22.8 | 43.3 | 32.5 |

TABLE 1-continued

The properties of the crosslinked compositions of the inventive and reference examples:

| | POLYMER COMPOSITION: | |
|---|---|---|
| | Ref. Ex. 8 | Ref. Ex. 9 |
| Polyolefin | LDPE1 | LDPE 1 |
| DCP (wt %) | 0.7 | 1.15 |
| mmol of —O—O—/kg polymer composition | 26 | 42 |
| 4,4'-thiobis (2-tertbutyl-5-methylphenol) (sulphur containing antioxidant) (wt %) | 0.08 | 0.08 |
| mmol of phenolic —OH/kg polymer composition | 4.5 | 4.5 |
| 2,4-Diphenyl-4-methyl-1-pentene (wt %) | 0.18 | 0.29 |
| Cross-linking temp [° C.] | 180 | 180 |
| Conductivity measured on cross-linked samples at 30 kV/mm and 70° C. (Not degassed) [fS/m] | 30 | 48 |

wt %-values given in the table are based on the total amount of the polymer composition.

TABLE 2

Properties of the polyolefin components

| Base Resin Properties | LDPE1 | LDPE2 |
|---|---|---|
| MFR 2.16 kg, at 190° C. [g/10 min] | 1.89 | 1.89 |
| Density [kg/m$^3$] | 923 | 921 |
| Vinyl [C = C/1000 C] | 0.54 | 0.82 |
| Vinylidene [C = C/1000 C] | 0.16 | 0.2 |
| Trans-vinylene [C = C/1000 C] | 0.06 | 0.09 |
| Crystallinity [%] | 48.8 | 43.9 |
| Melting point, $T_m$ [° C.] | 110.2 | 109.3 |

Table 1 shows that the electrical conductivity of cross-linked polymer compositions, which can be used as extruded insulation material according to the present invention (INV.Ex. 1-18) are markedly reduced compared to the reference examples (Ref. Ex. 2-9).

Load Cycle Test

During the load cycle test, the transmission cable is subjected to a DC voltage during cycles at negative polarity followed by cycles at positive polarity. A DC voltage of 1.85*$U_0$ may be used, wherein $U_0$ as defined above, for example 450 kV, or 525 kV, or above 450 kV, or between 450 and 1200 kV, for example at a voltage of 475, or 500, or 550, or 600, or 850 kV.

The number of cycles may vary from 5 to 25, or 5 to 20, or 10 to 25, or 10 to 15 cycles at negative or positive polarity. The same number of cycles may be used for both polarities.

Cycles at negative polarity followed by cycles at positive polarity may be followed by additional cycles at positive polarity, wherein the DC voltage is as defined above. The number of cycles used during the last positive polarity measurements may be less than the number of cycles used for the negative and/or positive cycles mentioned above. The number of cycles may be 1 to 20, or 1 to 10, or 5 to 10.

The same DC voltage may be used at all three polarities during one load cycle test.

The additional cycles at positive polarity may be performed during at least 1 to 25, or 4 to 15 days.

Optionally, the load cycle test may comprise a rest period of at least 72, or 48, or 24, or 12, or 10, or 8, or 6 hours between the blocks of different polarities. For example, the step of cycles at negative polarity may optionally be followed by a rest period of at least 6 to 10 hours. The rest period may be without voltage and the cable may be heated during the rest period.

Cigré TB496

The type tests as specified in Cigré TB496 are recommendations for testing DC extruded cable systems for rated transmission voltages $U_0$ up to 500 kV The electrical type test is specified in Cigré TB496, especially in chapter 4. The type test includes a load cycle test (§ 4.4.2) and a superimposed impulse voltage test (§ 4.4.3).

§ 4.3 Non-Electrical Type Test

Prior to the electrical test, the transmission cable comprising the extruded insulation material as described above, may be subjected to a mechanical preconditioning, as specified in IEC 62067[4], and/or subjected to mechanical tests as specified in Electra [9].

The cable length may be any suitable length, such as a length between 5 and 100 m, or around 40 meters.

The cable thickness depends on several factors, such as e.g. the specific insulation material used, the voltage used, etc. The material may have a thickness between 5 and 100 mm, or around 26 mm. The tests may be performed at a voltage 450, or 525 kV, or above 450, for example at a voltage of 475, or 500, or 550, or 600, or 850 kV. The tests may also be performed at a voltage between 450 and 1200 kV.

§ 4.4 Electrical Type Test

A principal overview of the electrical type test is described in Appendix C of Cigré TB496.

The thickness of the cable is measured by the method specified in IEC608111-1-1 [10]. The thickness varies as explained above. The nominal value tn may be between 5 and 50 mm, or for example 26 mm. The average thickness of the insulation does not exceed the nominal value by more than 25%, 15%, or 10%, or 5%.

§ 4.4.1 the Mechanical Preconditioning

The mechanical preconditioning as specified in IEC 62067[4] comprises bending.

The cable is subjected to mechanical tests as specified in Electra 171 [13].

Bending Test

The test sample is subjected to the following test sequence.

The cable is bent around a test cylinder at ambient temperature for at least one complete turn. Then it is straightened and twisted 180 degrees around its axis and bent again. This procedure is repeated three times. The actual bending diameter is less than or equal to 10 m, or 8 m, or 5 m, or 4.5 m, or 4.29 m.

§ 4.4.2 Load Cycle Test

The thermal conditions are as specified in § 1.5.5 of Cigré TB496 with a $T_{cond}$ of 70° C.

Load cycle test § 4.4.2.3 of Cigré TB496 with a $T_{cond}$ of 70° C.

8 h/16 h 12 load cycles with a DC voltage of $U_T$=−1.85*$U_0$ are performed followed by 12 load cycles with a DC voltage of $U_T$=+1.85*$U_0$. $U_0$ is $U_0$ as defined above, for example 450 kV, or 525 kV, or above 450 kV, or between 450 and 1200 kV, for example at a voltage of 475, or 500, or 550, or 600, or 850 kV. Each cycle consists of 8 hours heating with an AC or DC current followed by 16 hours natural cooling.

Examples of a tests, wherein $U_0$=450 kV and $U_T$=832 kV, or $U_0$=525 kV and $U_T$=972 kV.

1.1)

Twelve (12) "24 hours" load cycles at negative polarity $U_T$=832 kV, or 972 kV

Twelve (12) "24 hours" load cycles at positive polarity $U_T$=832 kV, or 972 kV

Three (3) "48 hours" load cycles at positive polarity $U_T$=832 kV, or 972 kV Between the cycles at different polarities a rest period of 48 hours without voltage, with heating was used.

All tests cycles 12+12+3 (minimum of 30 days) have been performed without electrical breakdown.

Figure 5:
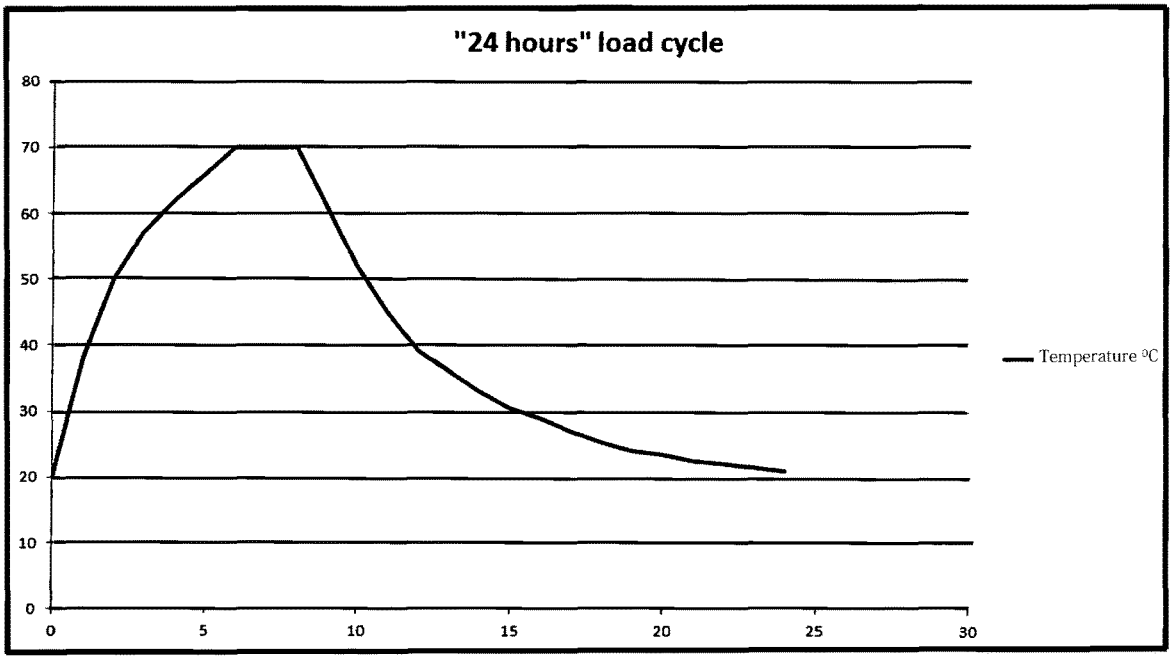
FIG. 5 shows a schematic graph from a 24 hours load cycle showing time versus temperature.

1.2) The following types of cycles have also been tested according to § 1.5.5 of Cigré TB496.

a) "24 hours" load cycles (defined as Load Cycles (LC) in § 1.5.5). FIG. 5 shows how the temperature of the conductor varies over time.

Figure 6:
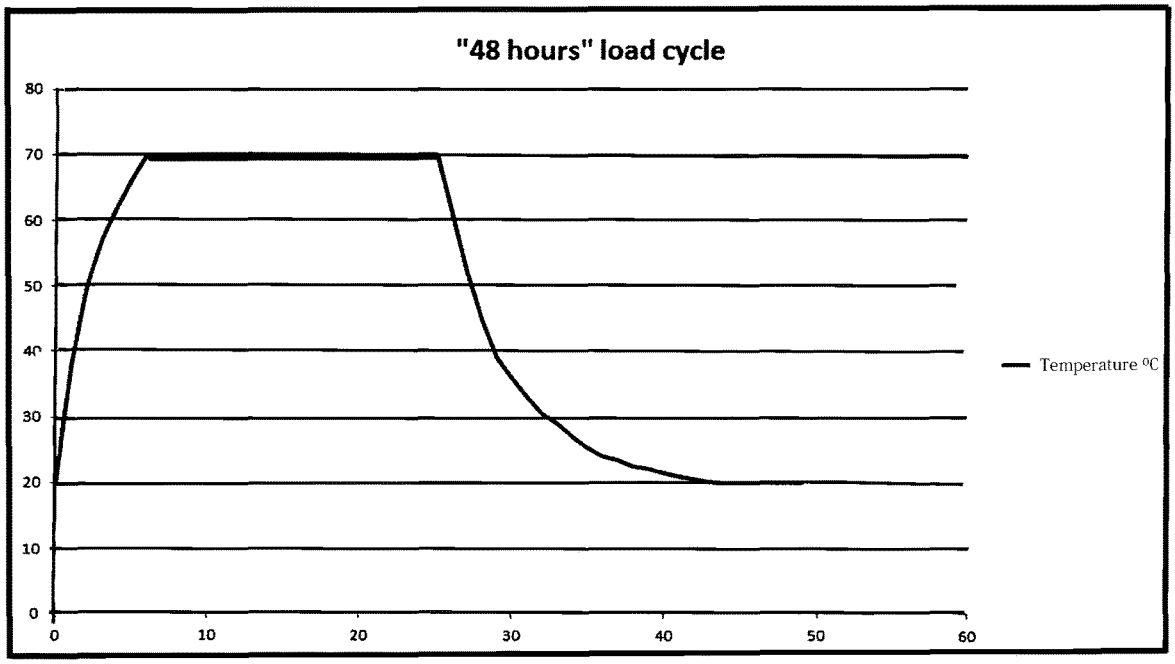
FIG. 6 shows a schematic graph from a 48 hours load cycle showing time versus temperature.

| $U_T$ (kV) | number of cycles |
|---|---|
| −832 | 2 |
| −925 | 2 |
| +925 | 2 |
| +1017 | 2 |
| +1110 | 2 |
| +1184 | 4 |
| +1250 | 1 |
| +1300 | 1 |

b) "48 hours" load cycles (defined as Load Cycles (LC) in § 1.5.5) FIG. 6 shows how the temperature of the conductor varies over time.

| $U_T$ (kV) | number of cycles |
|---|---|
| −832 | 1 |
| +925 | 1 |
| +1017 | 1 |
| +1110 | 1 |
| +1184 | 2 |

All tests cycles 12+12+3 (minimum of 30 days) have been performed without electrical breakdown.

§ 4.4.3 Superimposed Impulse Voltage Test

The test procedure as specified in § 1.5.6.2 of Cigré TB496 is used. The temperature conditions as defined in § 1.5.5 are achieved for at least 10 hours, whereby $T_{cond}$ was 70° C.

The superimposed impulse voltage is applied according to the procedure described in Electra 189[9].

The switching impulse withstand test is qualified for VSC as specified in § 4.4.3.3 of Cigré TB496.

Superimposed Switching Surge Withstand Test 10 hours before the first impulse the cable is pre-stressed, whereby a power is introduced on the cable and the cable is heated and maintained at a temperature above the maximal conductor temperature in normal operation (herein referred to as "heated" or "pre-stressed/heated").

The nominal DC voltage, $U_0$, is applied at least 10 hours before the first impulse. $U_0$ is for example, for example 450 kV, or 525 kV, or above 450 kV, or between 450 and 1200 kV, for example at a voltage of 475, or 500, or 550, or 600, or 850 kV.

Test Impulse Shape:

Time to crest $T_p$=250 μs±20%

Time to half value $T_2$=2500 μs±60%

The impulse test is performed in the test sequence shown below:

Tests sequences examples for 450 kV, or 525 kV:

- Cable pre-stressed/heated at +450 kV, or +525 kV. 10 positive surges+$U_{P2,5}$+862 kV resp. +1006 kV. 250/2500 s
- Cable pre-stressed/heated at +450 kV, or +525 kV. 10 negative surges −$U_{P\ 2,O}$−412 kV resp. −481 kV. 250/2500 s
- Cable pre-stressed/heated at −450 kV, or −525 kV. 10 negative surges −$U_{P2,S}$−862 kV resp.−1006 kV. 250/2500 s
- Cable pre-stressed/heated at −450 kV, or −525 kV. 10 positive surges +$U_{P2,O}$+412 kV resp. +481 kV. 250/2500 s Subsequent DC Test A negative DC voltage of 1.85*$U_0$ is applied to the test object and maintained for 2 hours. The test is performed without conductor heating.

$U_0$ is for example 450 kV, or 525 kV, or above 450 kV, or between 450 and 1200 kV, for example at a voltage of 475, or 500, or 550, or 600, or 850 kV Another example of a DC voltage may be 832 kV or 972 kV.

The lightning impulse withstand test is performed according to the principles given in § 4.4.3.4 of Cigré TB496.

§ 4.4.5 Examination

A 1 m sample may be subjected to the tests and requirements specified in IEC 62067 [4].

§ 4.4.6 Success Criteria, Re-Testing and Interruptions

The electrical test was performed without breakdown.

The term "conductor" as used herein, means a conductor or a superconductor, which may be one or more conductors bundled together.

The wording "between" as used herein includes the mentioned values and all values in between these values. Thus, a value between 1 and 2 mm includes 1 mm, 1.654 mm and 2 mm.

The wording "low density" as used herein means densities of the polymer between 0.80 and 0.97 g/cm$^3$, for example between 0.90 and 0.93 g/cm$^3$.

The wording "high voltage or HV" as used herein is meant to include high voltage and ultra high voltage (UHV) in direct current or alternating current systems.

The wording "rated" voltage $U_0$ as used herein, means the DC voltage between the conductor and core screen for which the cable system is designed.

$U_T$ and $U_{P2,S}$, $U_{P2,O}$ are defined in § 1.5.3 of Cigré TB496.

The present invention is not limited to the embodiments disclosed but may be varied and modified within the scope of the following claims.

The invention claimed is:

1. A transmission cable comprising:

a conductor or a bundle of conductors extending along a longitudinal axis, the conductor or the bundle of conductors is circumferentially covered by an insulation layer comprising an extruded insulation material, wherein the extruded insulation material comprises a crosslinked polymer composition, which is obtained by crosslinking a polymer composition, the polymer composition comprises an LDPE, peroxide, and sulphur containing antioxidant, wherein the crosslinked polymer composition has an Oxidation Induction Time, determined according to ASTM-D3895, ISO/CD 11357 and EN 728 using a Differential Scanning calorimeter (DSC), which Oxidation Induction Time corresponds to Z minutes, and comprises an amount of peroxide by-products which corresponds to W ppm determined according to BTM2222 using HPLC, wherein $Z_1 \leq Z \leq Z_2, W_1 \leq W \leq W_2$, and $W \leq p - 270*Z$, wherein $Z_1$ is 0, $Z_2$ is 60, $W_1$ is 0 and $W_2$ is 9500, and p is 18500 and wherein the crosslinked polymer composition does not comprise 2,4-diphenyl-4-methyl-1-pentene, such that the transmission cable is configured to pass the electrical type test as specified in Cigré TB496, whereby the rated voltage $U_0$ is 450 kV or more.

2. The transmission cable according to claim 1, comprising concentrically arranged:

a first semiconducting layer circumferentially covering the conductor or the bundle of conductors, the insulation layer comprising the extruded insulation material circumferentially covering the first semiconducting layer, a second semiconducting layer circumferentially covering the insulation layer, and optionally a jacketing layer and armor covering an outer wall of the second semiconducting layer, whereby the transmission cable passes the electrical type test as specified in Cigré TB496, whereby the rated voltage $U_0$ is 450 kV, or more.

3. The transmission cable according to claim 1, wherein the type test comprises subjecting the transmission cable to a DC voltage of substantially $1.85*U_0$ for at least 30 days, and wherein $U_0$ is 450 kV, or more.

4. The transmission cable according to claim 1, wherein the type test comprises subjecting the transmission cable to a DC voltage of $1.85*U_0$ during 5 to 25 cycles at negative polarity, followed by a polarity reversal with another 5 to 25 cycles at positive polarity at a DC voltage of $1.85*U_0$, followed by additional 2 to 15 cycles during at least 4 to 15 days at positive polarity, and wherein $U_0$ is 450 kV, or more.

5. The transmission cable according to claim 1, wherein $U_0$ is 450 kV, or above.

6. The transmission cable according to claim 1, wherein $U_0$ is 525 kV, or more.

7. The transmission cable according to claim 1, wherein the conductivity of the extruded insulation material at 30 kV/mm and 70° C. is between 0.01 and 60 fS/m.

8. A transmission cable comprising a conductor or a bundle of conductors extending along a longitudinal axis, the conductor or the bundle of conductors is circumferentially covered by an insulation layer comprising an extruded insulation material, wherein the extruded insulation material comprises a crosslinked polymer composition, which is obtained by crosslinking a polymer composition, the polymer composition comprises an LDPE, peroxide, and sulphur containing antioxidant, wherein the crosslinked polymer composition has an Oxidation Induction Time, determined according to ASTM-D3895, ISO/CD 11357 and EN 728 using a Differential Scanning Calorimeter (DSC) which Oxidation Induction Time corresponds to Z minutes, and comprises an amount of peroxide by-products which corresponds to W ppm determined according to BTM2222 using HPLC, wherein $Z_1 \leq Z \leq Z_2, W_1 \leq W \leq W_2$, and $W \leq p - 270*Z$, wherein $Z_1$ is 2, $Z_2$ is 20, $W_1$ is 0, $W_2$ is 9000, and p is 16000 and wherein the crosslinked polymer composition does not comprise 2,4-diphenyl-4-methyl-1-pentene such that the transmission cable is configured to pass the electrical type test as specified in Cigré TB496, whereby the rated voltage $U_0$ is 450 kV or more.

* * * * *